US009959817B2

(12) United States Patent
Chang et al.

(10) Patent No.: US 9,959,817 B2
(45) Date of Patent: May 1, 2018

(54) DISPLAY AND SCANNING METHOD THEREOF

(71) Applicant: Fitipower Integrated Technology Inc., Hsinchu (TW)

(72) Inventors: Kuei-Kai Chang, Zhubei (TW); Chun-Fu Liu, Jhubei (TW); Li-Shen Chang, Hsinchu (TW); Lu-Yao Wu, Changhua (TW)

(73) Assignee: Fitipower Integrated Technology Inc., Hsinchu (TW)

( * ) Notice: Subject to any disclaimer, the term of this patent is extended or adjusted under 35 U.S.C. 154(b) by 13 days.

(21) Appl. No.: 15/099,159

(22) Filed: Apr. 14, 2016

(65) Prior Publication Data

US 2016/0307495 A1 Oct. 20, 2016

(30) Foreign Application Priority Data

Apr. 15, 2015 (TW) ..... 104112097 A

(51) Int. Cl.
*G09G 3/36* (2006.01)
*G09G 3/34* (2006.01)

(52) U.S. Cl.
CPC ..... *G09G 3/344* (2013.01); *G09G 2310/0213* (2013.01); *G09G 2330/021* (2013.01)

(58) Field of Classification Search
CPC .. G09G 3/20; G09G 3/30; G09G 3/36; G09G 5/00; G06F 3/038; H01L 23/48
See application file for complete search history.

(56) References Cited

U.S. PATENT DOCUMENTS

2010/0164856 A1* 7/2010 Liao ..... G09G 3/3225 345/102
2014/0110852 A1* 4/2014 Yoshida ..... G02F 1/13452 257/773
2016/0035302 A1* 2/2016 Sun ..... G09G 3/3648 345/209
2016/0210916 A1* 7/2016 Jeong ..... G09G 3/3614
2016/0343320 A1* 11/2016 Tann ..... G09G 3/3618

* cited by examiner

*Primary Examiner* — Pegeman Karimi
(74) *Attorney, Agent, or Firm* — Muncy, Geissler, Olds & Lowe, P.C.

(57) ABSTRACT

A scanning method of a display of the present invention changes a driving order of a plurality of gate driver lines according to a frame data so as to reduce switching currents generated while a plurality of voltages on a plurality of source driver lines are changed. Thereby, the goal of saving power can be reached.

5 Claims, 19 Drawing Sheets

DISPLAY AND SCANNING METHOD THEREOF

CROSS-REFERENCE TO RELATED APPLICATIONS

This application claims the priority benefit of Taiwan Patent Application No. 104112097, filed Apr. 15, 2015, the contents of which in its entirety are herein incorporated by reference.

FIELD OF THE INVENTION

The present invention is related generally to a display method and, more particularly, to a scanning method of a display.

BACKGROUND OF THE INVENTION

Generally, electrophoretic display (EPD) has bistability and thus only consumes power at the moment of changing images. Thus, the EPD advantageously has lower power consumption. Such EPD utilizes the reflection technology, and the display effect and the image quality thereof are close to paper. Accordingly, the EPD is mostly applied in the electronic paper or electronic tags. FIG. 1 depicts an EPD, which includes a panel 10, a controller 12, a plurality of gate driver lines G1-G8, and a plurality of source driver lines S1-S8. There are several pixels 14 on the panel 10, and each pixel 14 is connected to one gate driver line and one source driver line. When the controller 12 receives a frame data, the controller 12 starts to drive the gate driver lines in orders of the location of the gate driver lines G1-G8, from the gate driver line G1 to the gate driver line G8 as shown in FIG. 2. In the meantime, the controller 12 determines the levels of a plurality of voltages which are applied to the source driver lines S1-S8 according to the frame data and the gate driver line that is driven. Referring to FIGS. 1 and 3, while driving the gate driver line G1, the controller 12 realizes that the pixels at (G1, S1), (G1, S5), (G1, S7) and (G1, S8) are set by black and the pixels at (G1, S2), (G1, S3), (G1, S4) and (G1, S6) are set by white according to the frame data. Thus, the controller 12 will apply a low level voltage to the source driver lines S1, S5, S7 and S8 and apply a high level voltage to the source driver lines S2, S3, S4 and S6, respectively. While driving the gate driver line G2, the controller 12 realizes that the pixels at (G2, S2), (G2, S3) and (G2, S5) are set by black and the pixels at (G2, S1), (G2, S4), (G2, S6), (G2, S7) and (G2, S8) are set by white according to the frame data. Thus, the controller 12 will apply the low level voltage to the source driver lines S2, S3 and S5 and apply the high level voltage to the source driver lines S1, S4, S6, S7 and S8, respectively.

In the EPD, when the voltages on the source driver lines S1-S8 change, switching currents IS1-IS8 will be generated. For example, when the gate driver line G1 in FIG. 1 stops driving, the gate driver line G2 will be driven sequentially. Referring to FIG. 3, the voltage levels on the source driver lines S1, S2, S3, S7 and S8 change, and the switching currents IS1, IS2, IS3, IS7 and IS8 are generated as shown in FIG. 4. Herein, generating the switching currents IS1-IS8 brings about the power consumption. In fact, the electronic paper and the electronic tags are mostly developed portable. Thus, the technology of the EPD should consider saving power.

However, besides the EPD, other displays (for example, the liquid crystal display, LCD) that utilize the gate driver lines and the source driver lines to change the color or the gray scale of the pixels also adversely generate the switching currents in time of changing the color or the gray scale of the pixels. Accordingly, such technology still fails to avoid wasting power.

Therefore, it is desired a method for lowering the switching current in order to reduce the power consumption.

SUMMARY OF THE INVENTION

An objective of the present invention is to provide a scanning method for reducing the power consumption of a display.

Another objective of the present invention is to provide a display that saves power.

According to the present invention, a scanning method of a display comprising steps of: (A) selecting one of a plurality of gate driver lines to obtain a first gate driver line that is to be firstly driven; (B) selecting another gate driver line from the gate driver lines that are not selected to obtain a second gate driver line that is to be secondly driven, such the second gate driver line allowing a plurality of voltages on a plurality of source driver lines to be changed the least; and (C) judging if there are any of the gate driver lines that are not selected, executing the step B again if the judgment is yes, ending up if the judgment is no.

According to the present invention, a display comprises a plurality of gate driver lines and a plurality of source driver lines, wherein the gate driver lines are driven by a first driving order when the display displays a first frame data and driven by a second driving order different from the first driving order when the display displays a second frame data; wherein a first image that is displayed by the display according to the first frame data has a first number of times for color changing on a direction of the source driver lines, a second image that is displayed by the display according to the second frame data has a second number of times for color changing on the direction of the source driver lines, and the first number is less than the second number.

Accordingly, the present invention changes the driving order of the gate driver lines in order to reduce the switching current that is generated in time of changing the voltages on the source driver lines. Thus, the present invention can reduce power consumption. Please be noted that the present invention is not limited by aforementioned method.

BRIEF DESCRIPTION OF THE DRAWINGS

These and other objectives, features and advantages of the present invention will become apparent to those skilled in the art upon consideration of the following description of the preferred embodiments according to the present invention taken in conjunction with the accompanying drawings, in which.

DETAILED DESCRIPTION OF THE INVENTION

Figure 5:
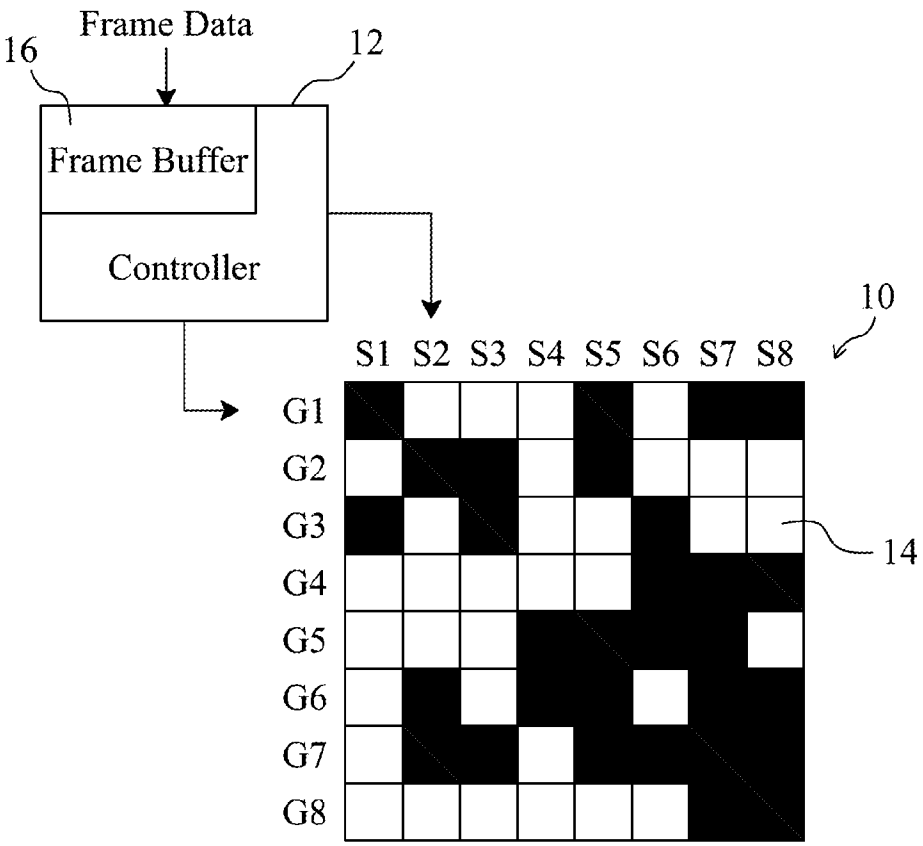
FIG. 5 shows an EPD applied in a scanning method of the present invention.

FIG. 5 shows an electrophoretic display (EPD) applied in a scanning method of the present invention. The EPD comprises a panel 10, a controller 12, a plurality of gate driver lines G1-G8 and a plurality of source driver lines S1-S8. There are several pixels 14 on the panel 10, and each pixel 14 is connected to one gate driver line and one source driver line. The controller 12 includes a frame buffer 16, which is provided for saving a preset algorithm and a frame data. The preset algorithm ranks a driving order of the gate driver lines G1-G8 according to the saved frame data, so that the gate driver lines G1-G8 can be driven randomly, namely, not by numbers of the location of the gate driver lines G1-G8. Moreover, the driving order of the gate driver lines G1-G8 varies with the frame data. The driving order that is newly ranked can be saved in the frame buffer 16, and the controller 12 can drive the gate driver lines G1-G8 according to the saved driving order.

Figure 6:
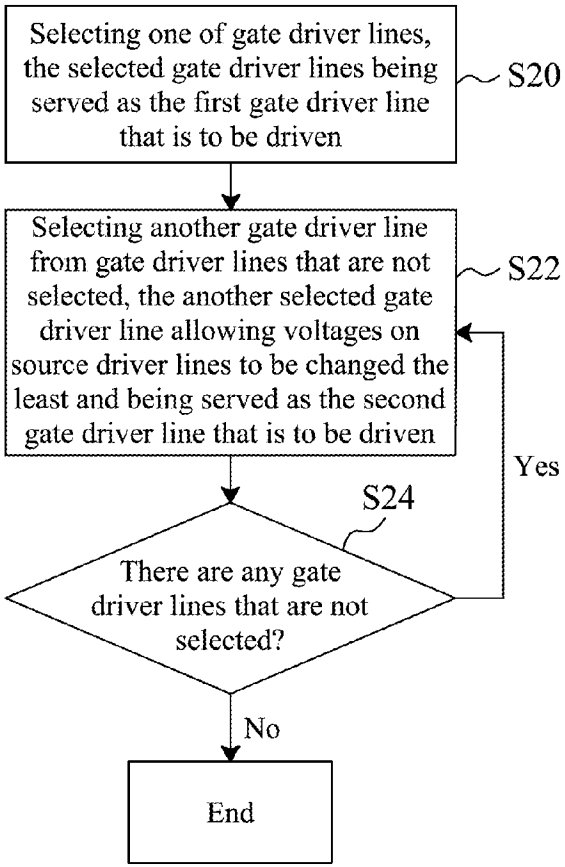
FIG. 6 shows the scanning method of the present invention that changes a driving order.
Figure 7:
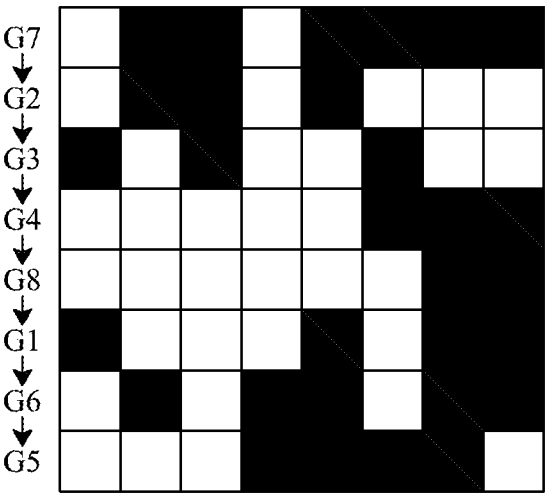
FIG. 7 shows the driving order of the gate driver lines G1-G8 in FIG. 5.
Figure 8:
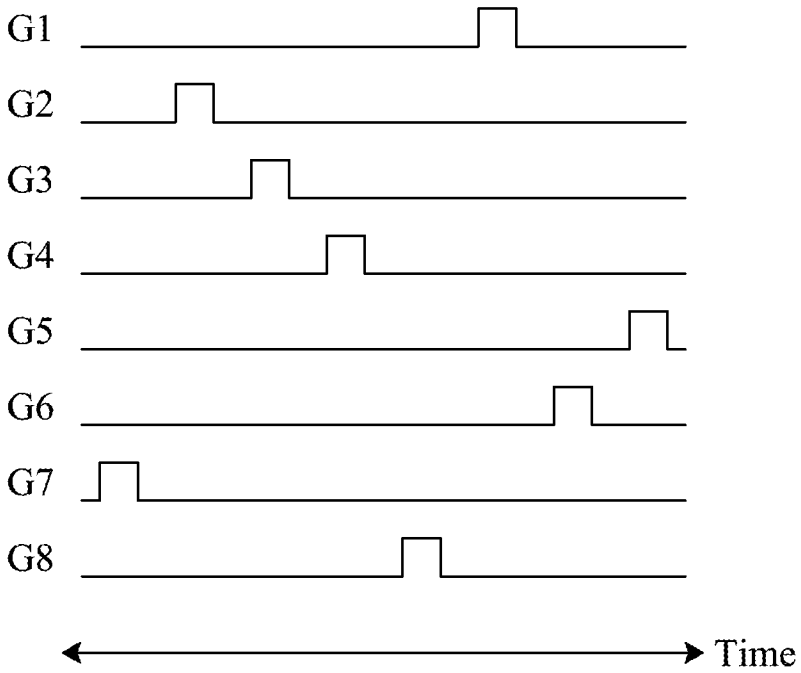
FIG. 8 shows waveforms of signals on the gate driver lines that are corresponding to the driving order in FIG. 7.

FIG. 6 shows a scanning method of the present invention for changing the driving order. FIG. 7 shows the driving order of the gate driver lines G1-G8 in FIG. 5. In FIG. 7, the driving order of the gate driver lines G1-G8 merely presents the driving order; the location of the gate driver lines G1-G8 is not changed. FIG. 8 shows changing a time order of the signals on the gate driver lines G1-G8. The panel 10 presents the same image as that shown in FIG. 5. After the controller 12 receives the frame data of the image corresponding to the panel 10 in FIG. 5, the scanning method of the present invention allows one of the gate driver lines G1-G8 to be selected for being served as a first gate driver line that is to be firstly driven as shown by step S20 in FIG. 6. Referring to the embodiment in FIG. 7, the gate driver line G7 is selected to be the first gate driver line that is to be firstly driven since the gate driver line G7 allows a plurality of voltages on the source driver lines S1-S8 to include the most number of low level voltages. Namely, the gate driver line G7 that has the most number of black pixels is selected. In other embodiments, the gate driver line G8 can be also selected, such the gate driver line G8 allows the voltages to contain the most number of high level voltages. Namely, the gate driver line G8 that has the most number of white pixels is selected. Alternatively, any gate driver line can be selected. When the gate driver line that has the most number of black pixels or the most number of white pixels is selected for being served as the first gate driver line that is to be firstly driven, if there are at least two gate driver lines that have the most number of black pixels or the most number of white pixels, one of the at least two gate driver lines can be randomly selected for being served as the first gate driver line. After the gate driver line G7 is selected for being served as the first gate driver line that is to be firstly driven, step S22 in FIG. 6 will be executed. In step S22, another gate driver line is selected from the gate driver lines that are not selected, such the selected gate driver line allows the voltages on the source driver lines S1-S8 to be changed the least, so that the selected gate driver line can be served as a second gate driver line that is to be secondly driven. That is to say, the color of the pixels on the present selected gate driver line G7 is regarded as a standard, and another gate driver line that color thereof changes the least on the direction perpendicular to the gate driver line G7 will be selected for being served as the second gate driver line that is to be secondly driven. As shown by the image in FIG. 5, the preset algorithm is applied, so that the gate driver lines G2 and G6 are acquired since the two gate driver lines G2 and G6 allow the voltages on the source driver lines S1-S8 to be changed the least. The two gate driver lines G2 and G6 both change the voltages of three source driver lines only. Herein, one of the gate driver lines G2 and G6 can be randomly selected for being served as the second gate driver line that is to be secondly driven. In the embodiment shown in FIG. 7, the gate driver line G2 is selected for being served as the second gate driver line that is to be secondly driven. In other embodiments, the gate driver line G6 can be alternatively selected for being as the second gate driver line that is to be secondly driven. Accordingly, step S24 in FIG. 6 will be executed. In step S24, the rest of the gate driver lines that are not selected yet will be judged. Herein, the gate driver lines G1, G3-G6 and G8 are not selected yet. Accordingly, step S22 will be executed again, and the present selected gate driver line G2 is regarded as the standard. Wherein, the gate driver line G3 is selected since the gate driver line G3 allows the voltages on the source driver lines S1-S8 to be changed the least, so that the gate driver line G3 is served as the next gate driver line that is to be next driven. By repeating steps S22 and S24, all the gate driver lines G1-G8 will be selected. After that, the operation can be ended, and a driving order of the gate driver lines G1-G8 can be acquired.

Figure 1:
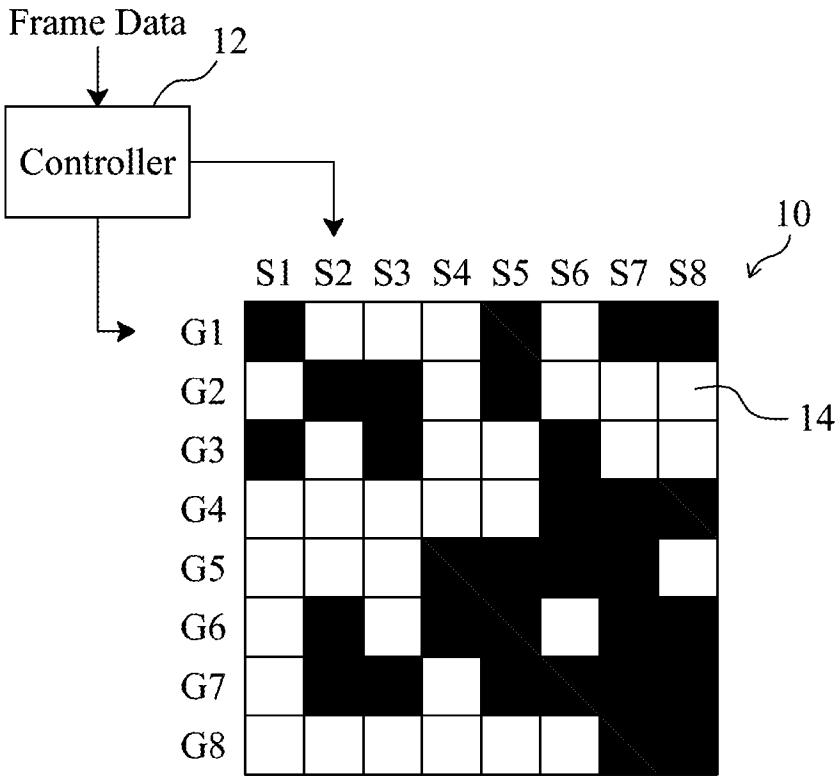
Fig. 1 Prior Art
FIG. 1 shows a conventional EPD.
Figure 4:
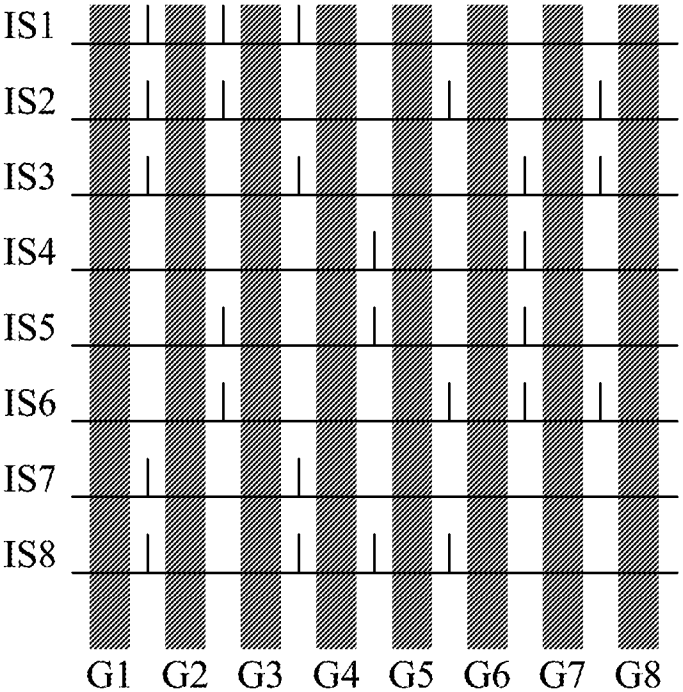
Fig. 4 Prior Art
FIG. 4 shows switching currents of the EPD in FIG. 1.
Figure 9:
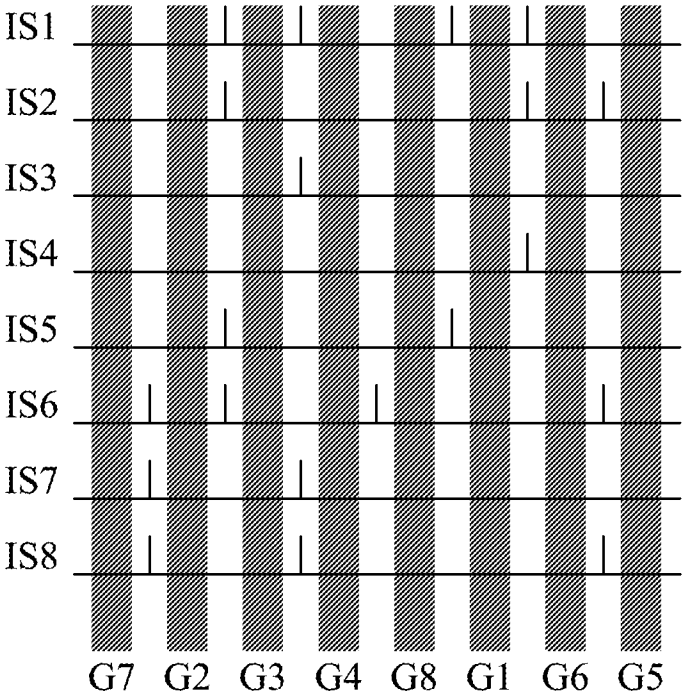
FIG. 9 shows switching currents that are generated in accordance with the driving order in FIG. 7.

In FIGS. 1 and 5, the panel 10 shows the same image. In FIG. 4, switching currents IS1-IS8 are generated while the gate driver lines G1-G8 in FIG. 1 are driven by numbers of the location of the gate driver lines G1-G8 (i.e., the driving order is G1→G2→G3→G4→G5→G6→G7→G8). FIG. 9 shows the switching currents IS1-IS8 generated after the driving order of the gate driver lines G1-G8 is rearranged according to the method of the present invention shown in FIG. 7 (i.e., the driving order is G7→G2→G3→G4→G8→G1→G6→G5). Comparing FIG. 4 with FIG. 9, twenty-six (26) switching currents will be generated according to the conventional scanning method since the gate driver lines G1-G8 are driven by numbers of the location of the gate driver lines G1-G8. Differently, only twenty (20) switching currents will be generated according to the scanning method of the present invention since the driving order of the gate driver lines G1-G8 is changed. Obviously, the present invention almost saves 23% of power.

Figure 10:
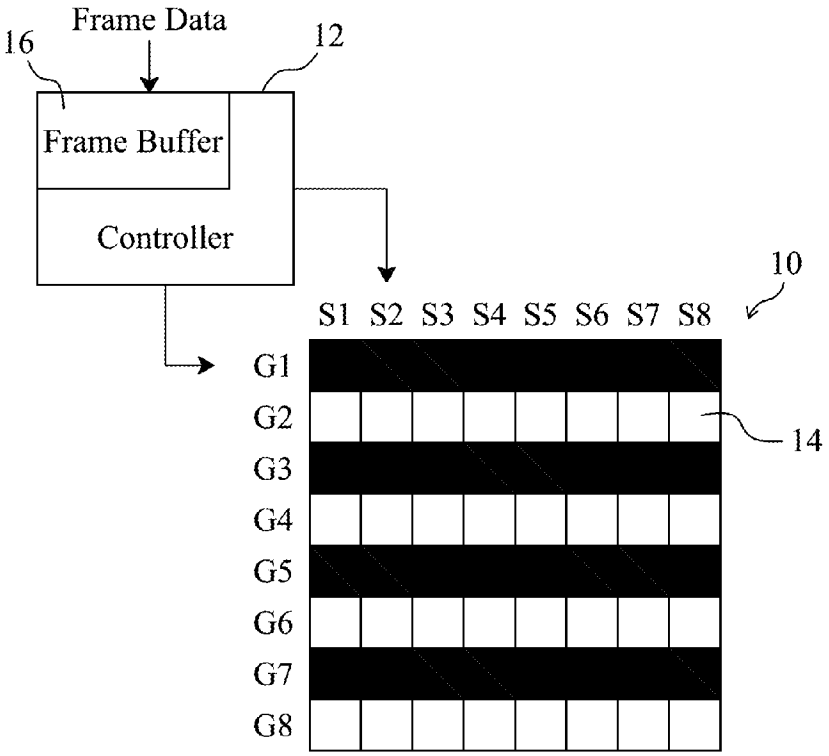
FIG. 10 shows an embodiment of a stripe image.
Figure 11:
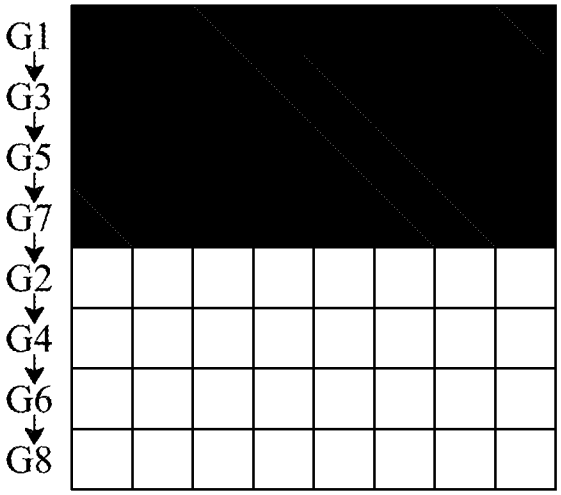
FIG. 11 shows the driving order of the gate driver lines G1-G8 in FIG. 10.

FIG. 10 shows an embodiment with a stripe image. When the stripe image is shown, fifty-six (56) switching currents will be generated according to the conventional method since the gate driver lines G1-G8 are driven by numbers of the location of the gate driver lines G1-G8. Differently, if the scanning method of the present invention is applied and the driving order of the gate driver lines G1-G8 is changed, the driving order (G1→G3→G5→G7→G2→G4→G6→G8) as shown in FIG. 11 can be acquired. Namely, only eight (8) switching currents will be generated. Compared with the conventional method, the method of the present invention saves 86% of power.

Figure 12:
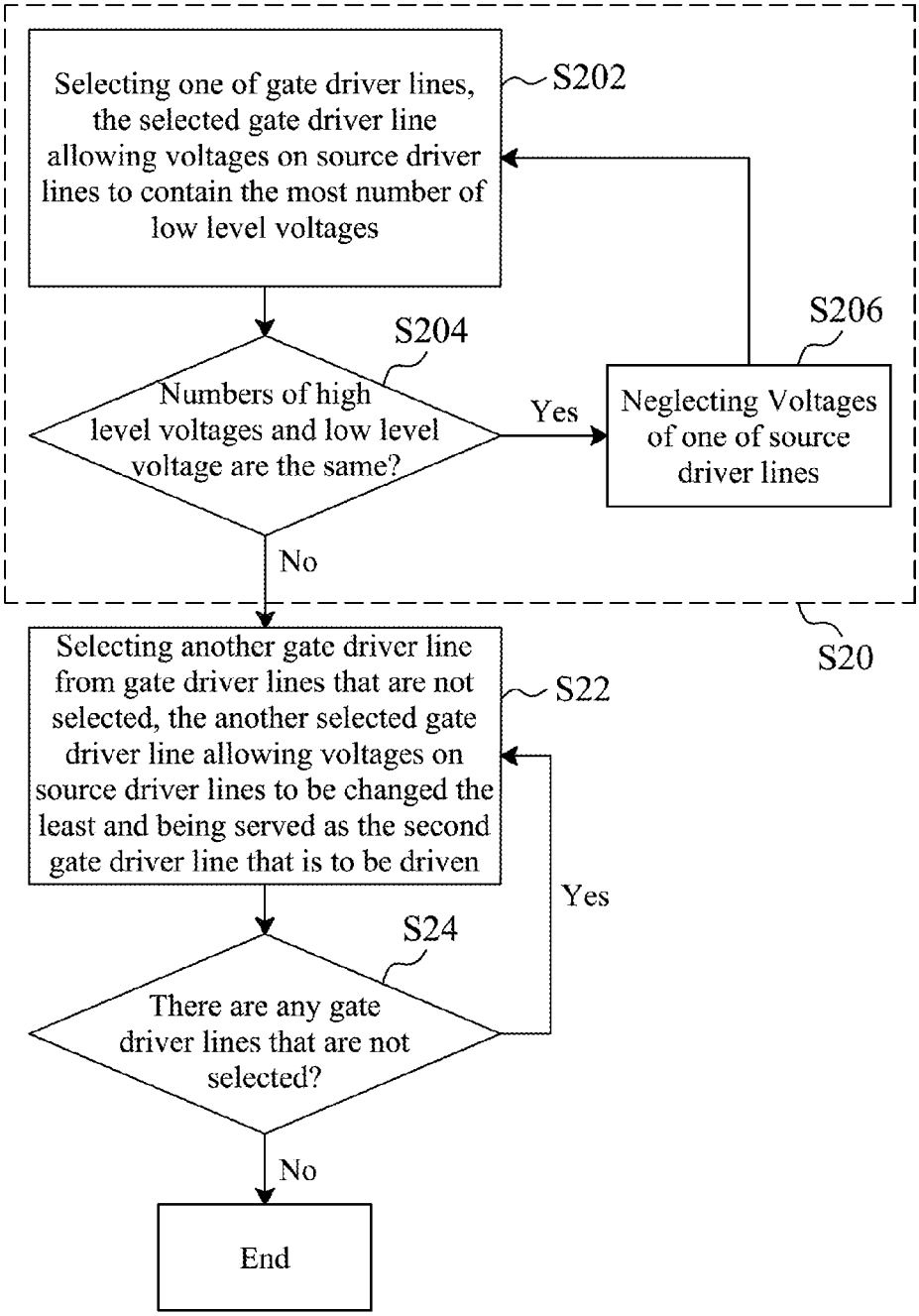
FIG. 12 shows one embodiment of step S20 in FIG. 6.
Figure 14:
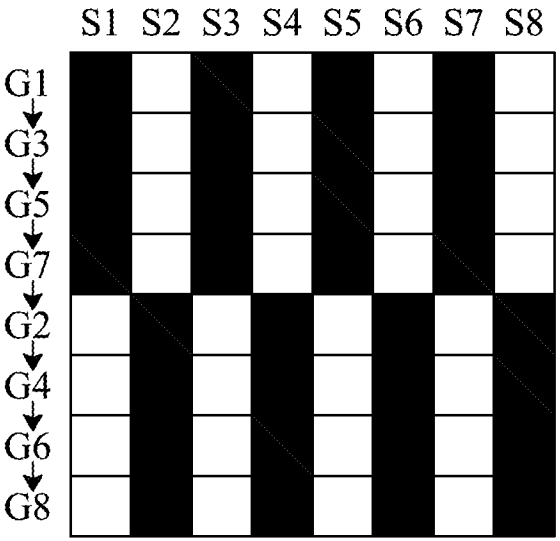
FIG. 14 shows the interlaced image in FIG. 13 with the driving order of the gate driver lines G1-G8 that is applied in the method of the present invention.
Figure 13:
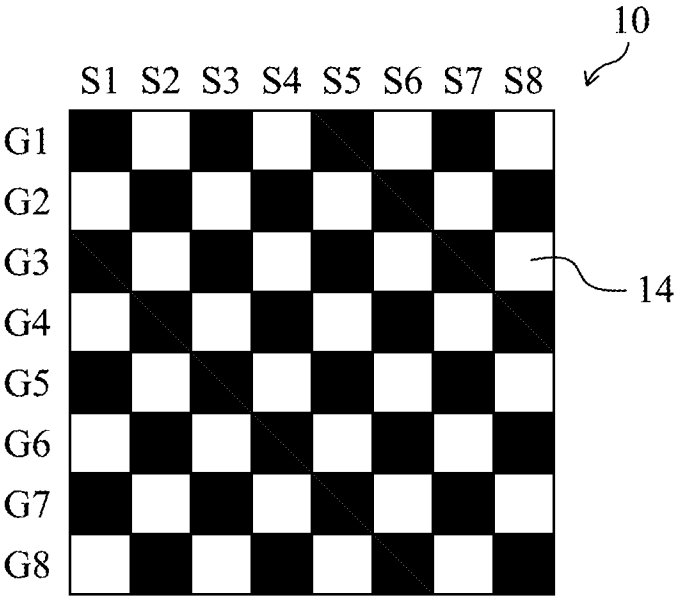
FIG. 13 shows an embodiment of an interlaced image.
Figure 15:
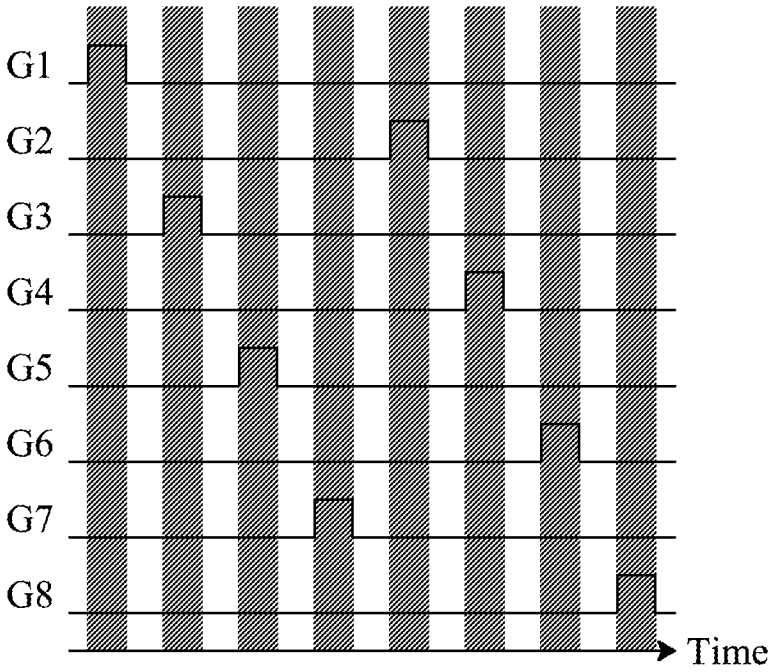
FIG. 15 shows waveforms of signals on gate driver lines G1-G8 in FIG. 13.

FIG. 12 shows an embodiment of step S20 in FIG. 6, and FIG. 13 shows an embodiment of an interlaced image. Referring to FIGS. 12 and 13, after the frame buffer 16 (as shown in FIG. 5) receives the frame data that is corresponding to the interlaced image, step S20 will be executed to select the first gate driver line that is to be firstly driven. In step S20, step S202 will be firstly executed, so that one gate driver lines will be selected from the gate driver lines G1-G8, such the selected gate driver line allows the voltages on the source driver lines S1-S8 to contain the most number of low level voltages. Namely, the gate driver line that is corresponding to the most number of black pixels is selected, and the gate driver line G8 is selected in this embodiment. In other embodiments, the gate driver line that is corresponding to the most number of white pixels (high level voltages) can be alternatively selected. In step S204, from the voltages corresponding to the selected gate driver line G8, the numbers of the low level voltages (black pixels) and the high level voltages (white pixels) will be judged if they are the same. If the numbers are the same, step S206 will be executed. If the numbers are different, the selected gate driver line G8 will be served as the first gate driver line that is to be firstly driven. Referring to FIG. 13, the numbers of the black pixels and the white pixels that are corresponding to the selected gate driver line G8 are the same. Thus, step S206 is executed. In step S206, a voltage state of one of the source driver lines will be neglected. In this embodiment, the voltages of the source driver line S8 at the right side will be neglected. In other embodiments, the voltages of other source driver lines can be alternatively neglected. After executing step S206, step S202 is executed again. Wherein, the voltages of the source driver line S8 at the right side is neglected, so one gate driver lines from the gate driver lines G1-G8 will be selected again, such the selected gate driver line allows the rest of the voltages of the rest of the source driver lines S1-S7 to contain the most number of low level voltages. Herein, the gate driver line G1 is selected in this embodiment. After that, step S204 is executed. Hereby, only the voltages of the source driver lines S1-S7 are considered. Thus, the numbers of the black pixels and the white pixels are different. Accordingly, the selected gate driver line G1 will be served as the first gate driver line that is to be firstly driven. After selecting the first gate driver line G1 that is to be firstly driven, step S22 and step S24 will be executed in sequence so as to generate the driving order of the gate driver lines G1-G8. The descriptions of step 22 and step 24 are the same as those in the previous embodiments and thus are herein omitted. FIG. 14 shows the driving order of the interlaced image that is applied in the scanning method of the present invention. In fact, the locations of the gate driver lines G1-G8 are not changed, and the panel 10 shows the same image as that in FIG. 13. Differently, the time order of the voltages on the gate driver lines G1-G8 is changed as shown by waveforms in FIG. 15.

Figure 2:
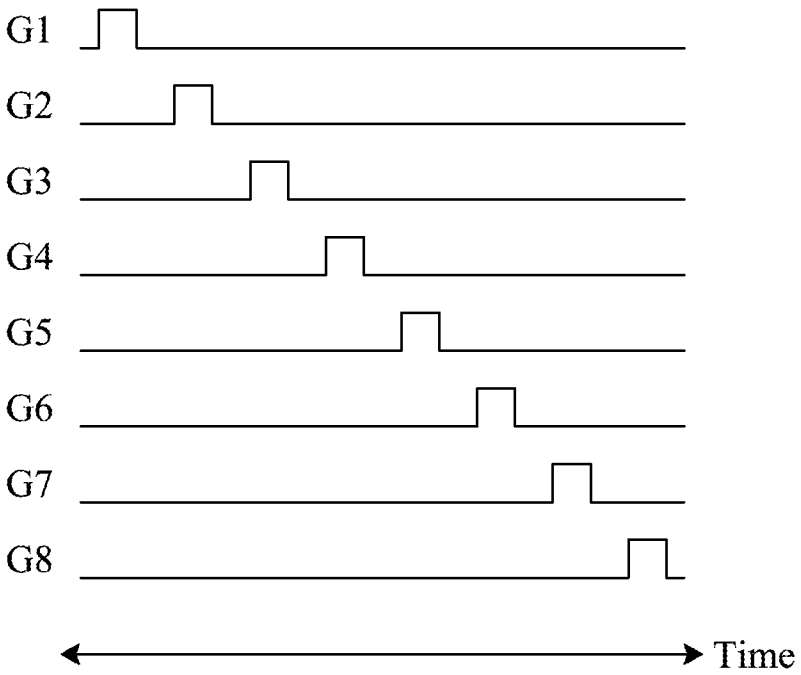
Fig. 2 Prior Art
FIG. 2 shows waveforms of signals on gate driver lines in FIG. 1.
Figure 3:
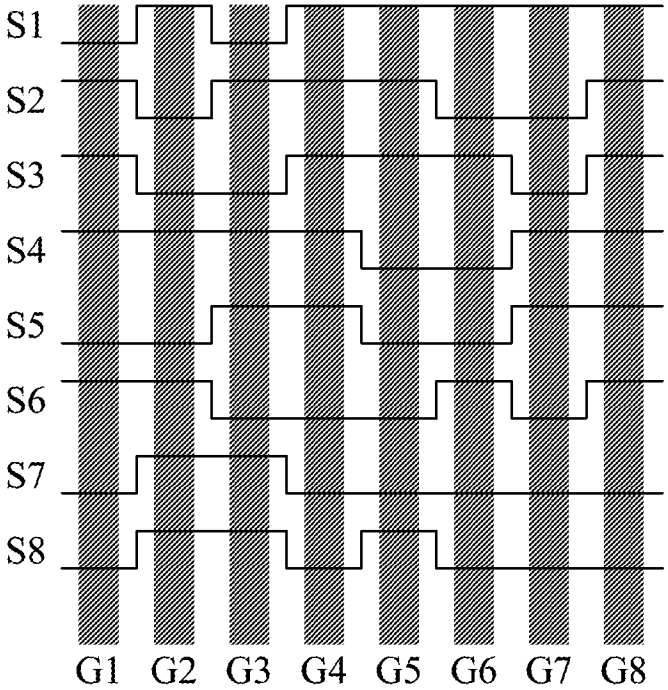
Fig. 3 Prior Art
FIG. 3 shows waveforms of voltages on source driver lines in FIG. 1.
Figure 16:
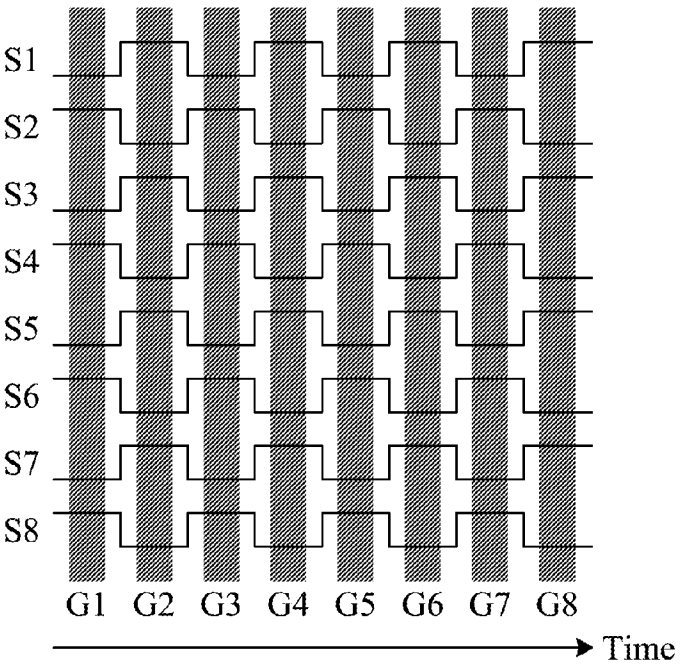
Fig. 16 Prior Art
FIG. 16 shows waveforms of voltages on source driver lines S1-S8 in time of generating the interlaced image via a conventional scanning method of FIG. 2.
Figure 17:
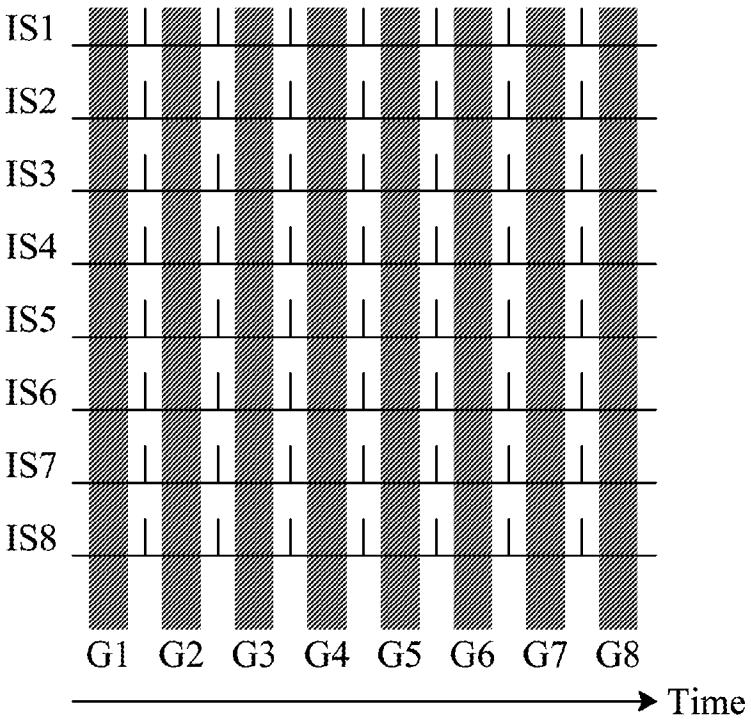
Fig. 17 Prior Art
FIG. 17 shows switching currents IS1-IS8 generated by the voltage waveforms corresponding to FIG. 16.
Figure 18:
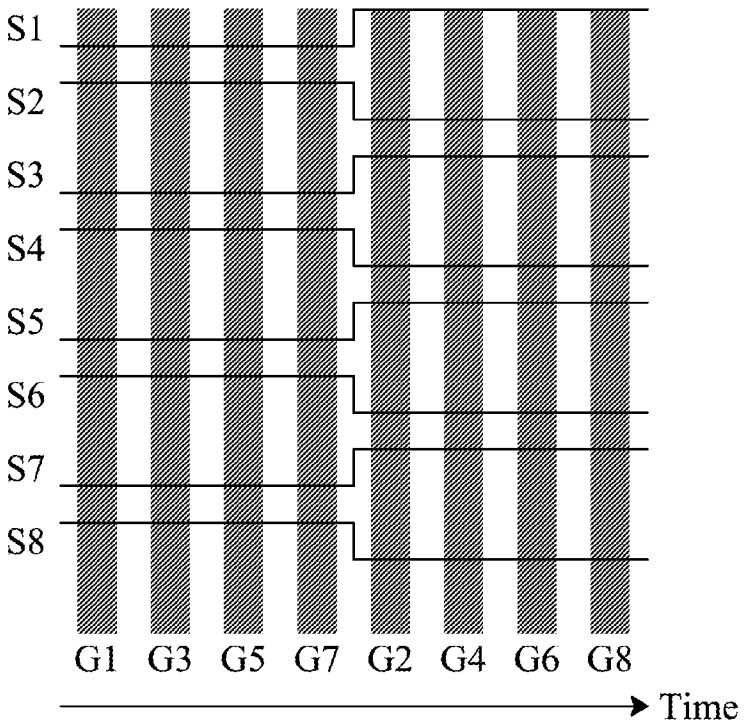
FIG. 18 shows voltage waveforms of source driver lines S1-S8 in time of generating the interlaced image via the scanning method of the present invention.
Figure 19:
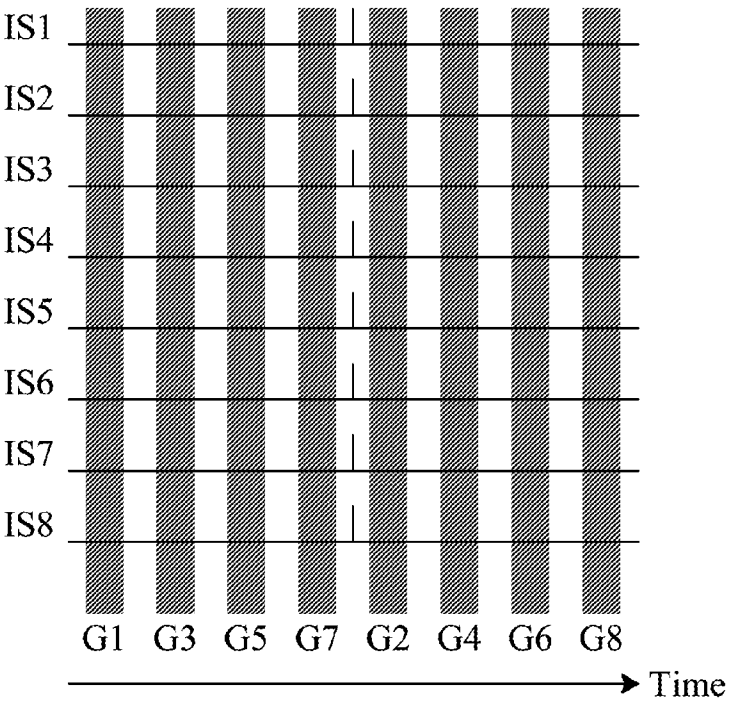
FIG. 19 shows switching currents IS1-IS8 generated by the voltage waveforms corresponding to FIG. 18.

Referring to FIG. 16, waveforms of voltages of the source driver lines while the interlaced image is generated according to the conventional scanning method in FIG. 2 are shown. FIG. 17 shows the switching currents IS1-IS8 generated corresponding to the waveforms of voltages in FIG. 16. FIG. 18 shows waveforms of voltages of the source driver lines while the interlaced image is generated according to the scanning method of the present invention. FIG. 19 shows the switching currents IS1-IS8 generated corresponding to the waveforms of voltages in FIG. 18. As shown by FIGS. 17 and 19, when the interlaced image is presented, fifty-six (56) switching currents will be generated while the conventional scanning method is applied. While the scanning method of the present invention is applied, there are only eight (8) switching currents, which eventually saves about 86% of power.

Figure 21:
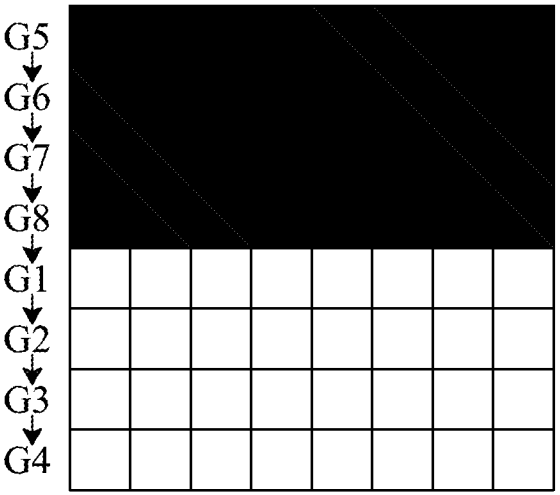
FIG. 21 shows the driving order of gate driver lines G1-G8 in FIG. 20.
Figure 20:
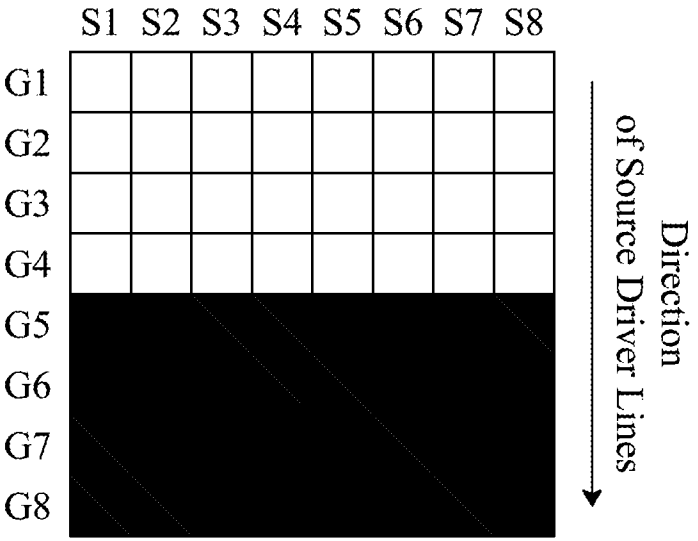
FIG. 20 shows an embodiment of a color block image.

When the conventional scanning method is applied, the driving order of the gate driver lines G1-G8 is the same no matter what kind of image is presented. However, when the scanning method of the present invention is applied, the driving orders of the gate driver lines G1-G8 are subjected to the practical images. For example, after the frame buffer 16 receives the frame data of the stripe image as shown in FIG. 10, the driving order of the gate driver lines G1-G8 (G1→G3→G5→G7→G2→G4→G6→G8) will be generated as shown by FIG. 11 according to the scanning method of the present invention (selecting the gate driver line that contains the most number of black pixels for being served as the first gate driver line that is to be firstly driven) in FIG. 6. After the frame buffer 16 receives the frame data of the color block image as shown in FIG. 20, the driving order of the gate driver lines G1-G8 (G5→G6→G7→G8→G1→G2→G3→G4) as shown in FIG. 21 will be generated according to the scanning method of the present invention in FIG. 6. From FIGS. 11 and 21, we can find that while the method of the present invention is applied, the images will change, but the driving order of the gate driver lines might not be the same. In the color block image in FIG. 20, the color on the direction of the source driver lines S1-S8 changes for 8 times. Such the number of times for color changing in FIG. 20 is less than the number of times (i.e., 56 times) for color changing on the direction of the source driver lines S1-S8 in FIG. 10.

In order to make a clearer depiction, afore embodiments of the present invention only take the images of two colors, black and white, as the preferable example. Please be noted that the method of the present invention is not limited in aforementioned embodiments. The method of the present invention can be also applied in the colored images or the images of gray scale. Moreover, besides the EPD, the present invention is also suitable for the display that utilizes the gate driver lines and the source driver lines to change the color or the gray scale of the pixels, for example the LCD.

While the present invention has been described in conjunction with preferred embodiments thereof, it is evident that many alternatives, modifications and variations will be apparent to those skilled in the art. Accordingly, it is intended to embrace all such alternatives, modifications and variations that fall within the spirit and scope thereof as set forth in the appended claims.

What is claimed is:

1. A scanning method of a display including a plurality of gate driver lines and a plurality of source driver lines, the scanning method comprising steps of:

A.) saving a frame data in a frame buffer;

B.) selecting one of the gate driver lines according to the saved frame data to obtain a first gate driver line that is to be firstly driven;

C.) selecting another gate driver line from the gate driver lines that are not selected according to the saved frame data to obtain a second gate driver line that is to be secondly driven, such the second gate driver line allowing a plurality of voltages on the source driver lines to be changed the least; and D.) judging if there are any the gate driver lines that are not selected, executing the step C again if the judgment is yes, ending up if the judgment is no.

2. The scanning method of claim 1, wherein the step B comprises a step of selecting one of the gate driver lines to obtain a selected gate driver line, such the selected gate driver line allows the voltages to contain the most number of high level voltages or the most number of low level voltages, so that the selected gate driver line is served as the first gate driver line that is to be firstly driven.

3. The scanning method of claim 1, wherein the step B comprises steps of:

selecting one of the gate driver lines to obtain a first selected gate driver line, such the first selected gate driver line allowing the voltages to contain the most number of high level voltages or the most number of low level voltages;

neglecting the voltages of one of the source driver lines if a first number of high level voltages and a second number of low level voltages in the voltages that are corresponding to the first selected gate driver line are the same, and then selecting one from the gate driver lines again to obtain a second selected gate driver line, such the second selected gate driver line allowing rest of the voltages of rest of the source driver lines to contain the most number of high level voltages or the most number of low level voltages, so that the second selected gate driver line being served as the first gate driver line that is to be firstly driven; and making the first selected gate driver line be served as the first gate driver line that is to be firstly driven if the first number and the second number are different.

4. The scanning method of claim 1, wherein the step C comprises a step of selecting one gate driver line randomly from at least two gate driver lines to obtain a selected gate driver line if the at least two driver lines allows the voltages to be changed the least, so that the selected gate driver line is served as the second gate driver line that is to be secondly driven.

5. A display comprising:

a plurality of gate driver lines, being driven by a first driving order when the display displays a first frame data, and driven by a second driving order different from the first driving order when the display displays a second frame data; and a plurality of source driver lines;

wherein a first image displayed by the display according to the first frame data has a first number of times for color changing on a direction of the source driver lines, a second image displayed by the display according to the second frame data has a second number of times for color changing on the direction of the source driver lines, and the first number is less than the second number, and wherein the first frame data is directed to a color block image, and the second frame data is directed to a stripe image.

* * * * *